US005322752A

United States Patent [19]

Gay

[11] Patent Number: 5,322,752

[45] Date of Patent: Jun. 21, 1994

[54] DEVELOPMENT PROCESS FOR ABRASION RESISTANT DOCUMENTS

[75] Inventor: Sally S. Gay, Ontario, N.Y.

[73] Assignee: Xerox Corporation, Stamford, Conn.

[21] Appl. No.: 688,377

[22] Filed: Apr. 19, 1991

Related U.S. Application Data

[63] Continuation of Ser. No. 852,254, Apr. 15, 1986, abandoned.

[51] Int. Cl.[5] ..... G03G 17/04

[52] U.S. Cl. ..... 430/37; 430/109; 430/110; 430/111; 430/126

[58] Field of Search ..... 430/37, 109, 110, 111, 430/126

[56] References Cited

U.S. PATENT DOCUMENTS

| | | | |
|---|---|---|---|
| 2,297,691 | 10/1942 | Carlson | 430/31 |
| 4,100,087 | 7/1978 | Takayama | 430/106.6 |
| 4,460,672 | 7/1984 | Gruber et al. | 430/110 |

OTHER PUBLICATIONS

Research Disclosure Journal Abstract No. 25317, published May 1985.

*Primary Examiner*—Steve Rosasco

*Attorney, Agent, or Firm*—Judith L. Byorick

[57] ABSTRACT

Disclosed is a process for generating images which comprises providing an original document with an image thereon, which image is developed with a composition comprised of resin particles, pigment particles, a low molecular weight wax component, and additive particles; and thereafter generating images therefrom; and wherein the original document subsequent to development is abrasion resistant.

28 Claims, No Drawings

DEVELOPMENT PROCESS FOR ABRASION RESISTANT DOCUMENTS

This is a continuation of application Ser. No. 06/852,254, filed Apr. 15, 1986, now abandoned.

BACKGROUND OF THE INVENTION

The present invention is generally directed to a process for obtaining images, and more specifically, the present invention is directed to the formulation of abrasion free and/or abrasion resistant documents with images thereon, which documents can be subsequently selected for utilization in electrostatographic imaging and printing processes. Thus, in one embodiment of the present invention there are provided original documents from electrostatographic imaging or printing processes wherein the images thereon have been permanently fused by, for example, radiant or flash fusing systems; and wherein the original can be subsequently utilized for extended time periods enabling the generation of additional copies therefrom with excellent resolution. Accordingly, thus the process of the present invention in one embodiment enables the generation of an original imaged document with certain developer compositions, which document is subsequently selected for obtaining copies therefrom, for example, in a xerographic imaging apparatus; and wherein the original document is substantially free of abrasion characteristics, and wherein toner flakes are not deposited on the recirculating original document. Moreover, in accordance with the process of the present invention there can be obtained smudge resistant images, that is, images with effective acceptable fixing; and additionally the developer composition selected, in some instances, prevents contamination of machine components such as corotrons present in the imaging apparatus. Furthermore, abrasion resistant image documents and other desirable characteristics illustrated hereinafter are achieved with the process of the present invention, particularly when there is selected for the generation of an original document developer compositions containing therein low molecular weight waxy components. One developer composition selected for the process of the present invention contains therein resin particles, particularly polyester polymers, pigment particles, inclusive of optional magnetite particles, low molecular weight waxy components, and additive particles of colloidal silicas and/or metal salts of fatty acids; and carrier components.

Presently, particularly with radiant and flash fused images, cycling with automatic document handlers incorporated into xerographic imaging or printing apparatuses causes the surfaces of the images to be scraped by, for example, the registration guide. This scraping action permits an undesirable build up of toner flakes on the registration guide, and further continued cycling of the images in the document handling results in transfer of the toner flakes accumulated on the registration guide to the images. Accordingly, when for example the imaged original documents which are generated from xerographic printing apparatuses including the Xerox Corporation 9700® are selected for further use in electrostatographic imaging processes for the purpose of obtaining additional copies from the original, the aforementioned copies having present thereon enhanced image defects including the presence of undesirable dark bands. These bands on the copies formulated from the original document are generally observed within from about 5 to 10 cyclings of the original radiant or flash fused original document. Specifically, therefore, it is desirable in some instances to select as originals for electrostatographic imaging processes defect free imaged documents or copies which have been initially generated in a xerographic printing apparatus, particularly those having incorporated therein laser printers; and wherein the toner image has been fused to the paper substrate by radiant or flash fusing systems. However, as indicated herein, in most instances the originals when subsequently cycled through document handlers present in xerographic imaging and printing apparatuses are subject to abrasion or scraping by elements of the document handler inclusive of the registration guide thereby permitting the undesirable deposition of toner flakes on the guide, and other machine parts. With continued cycling in the document handler, there results the transfer of the toner flakes which accumulate on the recirculating original image document, thus the copies made therefrom posses several undesirable characteristics including enhanced image defects as mentioned hereinbefore. This problem, as well as other problems as illustrated herein, are substantially eliminated with the process of the present invention, especially when there is selected for the formulation of the original imaged document a toner composition containing therein a low molecular weight wax such as a polyethylene or polypropylene enabling a toner image with a waxy surface. Apparently, although it is not desired to be limited by theory, it is believed that the dark bands and abrasion resistance is enabled by rendering the surface of the radiant or flash fused image document being selected as an original to assume a slippery appearance thereby permitting the image to slide, for example, rather than scrape over the machine components inclusive of the registration guide. This is particularly applicable to printers with lasers therein and wherein radiant and flash fusing processes are selected.

Developer compositions, including magnetic compositions and processes of imaging thereof, are known. There is thus disclosed in U.S. Pat. No. 3,345,294 a developer composition comprised of specific ingredients including, for example a resin, a major portion of which is a polyamide substance having a sharp melting point within the range of from about 70 degrees centigrade to about 165 degrees centrigrade. As disclosed in column 4, beginning at line 34 of this patent, a small amount of finely divided magnetic substance is added to the developer particles to reduce the tendency of the developer powder or toner to adhere to the background of the resulting print. Examples of magnetic substances recited in this patent are magnetic iron oxides, ferrosoferric oxide powders, a magnetic metal substance, or an alloy. The magnetic material is generally present in an amount of between 5 percent and 25 percent by weight, reference the disclosure in column 4, beginning at line 38, of the '294 patent.

Additionally, there is disclosed in U.S. Pat. No. 4,082,681, a magnetic developer for xerographic imaging systems comprised of a magnetic material dispersed in a resinous binder with finely divided solid substances such as conductive carbon black particles. This patent is representative of several patents disclosing the use of magnetic materials in developer compositions. Moreover, there is disclosed in U.S. Pat. No. 4,288,519, the disclosure of which is totally incorporated herein by reference, a specific dual purpose single component conductive magnetically attractive toner containing a mixture of a thermoplastic resin, finely divided magnetic pigments, and anchored conductive pigments, wherein as a resinous substance there can be selected a linear polyester consisting of the condensation product of an aromatic diol with an unsaturated aliphatic dibasic acid having a softening point of from about 95 degrees centigrade to about 150 degrees centrigrade, and an ethylenevinylacetate copolymer. Furthermore, the use of polyester resins as toner components are disclosed generally in U.S. Pat. No. 3,590,000, the disclosure of which is totally incorporated herein by reference.

Moreover, disclosed in U.S. Pat. No. 3,239,465 are two-component developer compositions comprised of specific resin particles and magnetite. According to the disclosure of this patent, reference column 9, beginning at line 56, examples of suitable electroscopic materials selected for the developer composition include phenolformaldehyde resins, rosin modified phenolformaldehyde resins, maleic glyceride, polystyrene, butadiene styrene copolymers, and other substances. There is incorporated into the toner of the '465 patent magnetic substances inclusive of magnetites in amounts, for example, of from about 20 percent to about 70 percent, reference the disclosure in column 10, beginning at line 41. Examples of granular carrier particles that may be selected are outlined in column 12, beginning at line 18, of the '465 patent.

Furthermore, there is disclosed in a copending application U.S. Ser. No. 713,975, entitled Developer Compositions, the disclosure of which is totally incorporated herein by reference, two-component developer compositions comprised of magnetite, a polyester resin, and carrier particles. The copending application is silent with respect to the addition of low molecular weight waxy components to the developer composition, and further there is no appreciation in the copending application relating to preventing the accumulation of toner flakes on a recirculating abrasion resistant original imaged document.

There is also illustrated in U.S. Pat. No. 4,460,672, the disclosure of which is totally incorporated herein by reference, positively charged toner compositions comprised of resin particles, pigment particles, a low molecular weight waxy material, and a charge enhancing additive inclusive of alkyl pyrridinium halides, and organic sulfonate compositions. Furthermore, there is disclosed in this patent the use of magnetic particles which can be present in the toner composition as the only pigment, or may be combined with other pigments such as carbon black. The magnetic pigments such as Mapico Black, according to the teachings of this patent, are generally incorporated into the toner composition in an amount of from about 10 percent by weight to about 60 percent by weight.

Additionally, there is illustrated in U.S. Pat. No. 4,271,248, the disclosure of which is totally incorporated herein by reference, methods for developing magnetic images with magnetic toners comprised of a magnetite material and a polyester; and in U.S. Pat. No. 4,272,600, the disclosure of which is totally incorporated herein by reference, magnetic toners containing, for example, styrene butadiene copolymers and magnetites such as Mapico Black in amounts of from about 40 to about 70 percent by weight.

Although the prior art processes are sufficient for their intended purposes, with some of these methods there is a tendency to contaminate the components present in the xerographic imaging apparatus. Thus, for example, the toner particles tend to separate from the carrier particles prior to, for example, contacting the latent image on the photoconductive member. The separated toner particles are then free to deposit on machine components, and thus contaminate the machine environment thereby resulting in developed images of low resolution or no developed images whatsoever; and causing possible environmental problems. Further, the deposition of the toner particles renders it necessary over a period of time to replace or clean the internal machine components which adds to the cost of maintenance. For example, when unused toner particles deposit on the optical systems present in electrophotographic machines, a latent image corresponding to the original to be copied will not be fully formed, if formed at all, on the photoreceptor surface thereby resulting in a final fused image of very low quality, which in some instances may be unreadable depending on the amount of toner particles deposited. Additionally, in some instances, the resulting images are not completely fixed to the final substrate causing undesirable smudging. Contamination and smudging is substantially eliminated with the process of the present invention in some instances primarily since the magnetic toner particles are prevented from separating from the carrier particles prior to, for example, contacting the latent image, which toner particles separate therefrom as a result of collisions between the toner particles and carrier particles contained in the developer composition with the components of the electrophotographic imaging apparatus.

Accordingly, there is a need for imaging and printing processes that prevent the contamination of internal machine components with toner particles. Furthermore, there is a need for improved imaging and printing processes that prevent the contamination of xerographic imaging apparatus, enable images that are smudge resistant, provide adequate fixing characteristics, and excellent charging properties.

Moreover, there is a need for imaging and printing processes which prevent the accumulation of toner flakes on an original imaged document generated in a xerographic imaging or printing apparatus. More specifically, with cycling, especially in imaging apparatuses with document handlers, there is a need for imaging and printing apparatuses wherein the surfaces of the original images remain unchipped, that is, do not flake off, and continually redeposit on the cycling original document and various transport mechanisms in the document handlers, for example the registration guides. Additionally, there is a need for abrasion resistant original imaged documents that can be selected for the formulations of images for extended time periods in xerographic imaging and printing apparatuses. Also, there is a need for imaging and printing processes wherein the documents selected are prevented from becoming defaced with abraded toner particles in patterns reflective of the geometry of the document handling device utilized. The aforementioned contamination of toner particles results in objectionable copy quality defects on documents generated from originals obtained, for example, from high speed printers such as the Xerox Corporation 9700®. Furthermore, the imaged originals generated may eventually become useless because of the released toner deposition thereon; and also the toner particles deposited on the transport mechanism within the document handlers incorporated in the electrostatographic imaging apparatus necessitate more frequent servicing of these handlers for the purpose of reducing and/or eliminating undesirable contamination effects. Additionally, there remains a need for imaging and printing processes wherein single, or two-component developer compositions with lubricants therein, and wherein imaged documents generated from an imaged original obtained in a xerographic imaging or printing apparatus are free of the appearance of undesirable dark bands thereon; and further wherein copies generated therefrom have substantially no image defects.

SUMMARY OF THE INVENTION

It is an object of the present invention to provide a process which overcomes many of the above-noted disadvantages.

In another object of the present invention there are provided developer compositions especially two-component magnetic substances which enable the development and formation of smudge resistant images.

Another important object of the present invention is the provision of an improved imaging process with magnetic developer wherein the toner particles are caused to adhere to the carrier particles, thus substantially eliminating the migration or movement of these particles in electrostatographic apparatuses.

A further object of the present invention resides in the provision of imaging and printing processes with developer compositions that prevent the unwanted deposition or contamination of toner particles on machine components. With certain developer composition of the present invention, the toner material is not free to contaminate machine components thereby prolonging the life thereof; and further these compositions permit the formation and development of images of high quality while simultaneously eliminating costly maintenance upkeep.

In a further object of the present invention there are provided processes with developer compositions comprised of polyester resins, magnetite substances, additive particles, and carrier particles, which compositions can be adequately fixed to substrates and enable smudge resistant images to be obtained.

Additionally, in a further object of the present invention there are provided imaging and printing processes with single or two-component developer compositions containing was therein, which processes enable the development and formation of images which are smudge resistant, and wherein the accumulation of toner flakes on an original developed document is avoided.

Furthermore, in another object of the present invention there are provided processes for generating original imaged documents in a xerographic imaging or printing process, and wherein copies made from such originals are not degraded by the presence of objectional streaks, smudges, and bands indicative of the document handling geometry selected; and also wherein the original is abrasion resistant especially in flash and radiant fussing systems.

Additionally, in yet a further object of the present invention there are provided imaging and printing processes with two-component magnetic developer compositions which simultaneously enable the generation of smudge-proof images; the avoidance of copy quality defects on copies generated from an imaged original developed with the aforementioned composition; the substantial elimination of image defects; and wherein abrasion of the original documents are prevented.

Furthermore, there is a specific need for abrasion resistant original imaged documents generated from printing apparatuses utilizing radiant or flash fusing technology, which originals are subsequently selected for the generation of copies in electrostatographic imaging apparatuses inclusive of the Xerox Corporation 8200® and the Xerox Corporation 9500®, which apparatuses can be equipped with automatic document handlers. Presently, when imaged originals generated from the aforementioned printers are utilized for the formulation of additional copies a scraping or defacing of the original image can result, and the toner flakes emitted accumulate in various areas of the document handlers, and on continued usage transfer to the copies being generated. This problem is substantially eliminated with the imaging and printing process of the present invention.

These and other objects of the present invention are accomplished by the provision of imaging and printing processes wherein, for example, the original document selected is abrasion resistant. More specifically, in accordance with one embodiment of the present invention there is provided a development process which comprises obtaining an imaged original document from an imaging or printing apparatus, and subsequently selecting this document for the generation of numerous copies, and wherein the original remains abrasion resistant. The aforementioned processes are accomplished by the selection of toners containing low molecular weight waxes therein. Moreover, with the processes of the present invention, the developer composition selected enables in addition to abrasion resistive images the prevention of flaking of, for example, the toner composition thereby preventing this composition from depositing on machine parts providing for reduced maintenance costs particularly servicing costs for the imaging apparatus involved. Additionally, with the imaging and printing processes of the present invention, there can be generated from an original imaged document numerous copies which are free of dark bands and other image defects.

In one specific embodiment of the present invention, the process comprises providing an original imaged document generated in a printing apparatus with a developer composition comprised of toner particles containing wax therein, which document is preferably permanently fixed by radiant or flash fusing processes; subsequently introducing the original document into an electrostatographic imaging apparatus; and thereafter generating copies from the original document wherein the original document selected possesses abrasion resistant characteristics. The additional copies can also be developed with a developer composition comprised of toner resin particles with a low molecular weight waxy component therein. Alternatively, the aforementioned copies can be developed with other toner, inclusive of those with no wax incorporated therein.

There can thus be selected as the preferred developer compositions for the processes of the present invention both single component developers, that is, those without carrier components therein; and containing, for example, a magnetic species; and two component developer compositions comprised of toners and carrier components, wherein each of the aforementioned developers include a low molecular weight waxy component therein.

With further respect to the toner composition, the toner resins can be comprised of various suitable effective substances such as known vinyl resins; styrene butadiene copolymers, reference for example U.S. Pat. No. 4,460,672, the disclosure of which was previously incorporated herein by reference; and preferably polyester resins inclusive of branched and unbranched resins. Examples of polyester resins selected for the developer composition of the present invention are comprised of the polymeric esterification product of a dicarboxylic acid and a diol comprising a diphenol of the following formula:

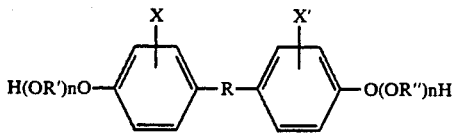

wherein R is selected from substituted and unsubstituted alkylene radicals having from about 2 to about 12 carbon atoms, alkylidene radicals with from 1 to about 12 carbon atoms, and cycloalkylidene radicals containing from 3 to about 12 carbon atoms; R' and R" are selected from substituted and unsubstituted alkylene radicals with from 2 to about 12 carbon atoms, alkylene arylene radicals of from 8 to about 12 carbon atoms and arylene radicals; X and X' are selected from hydrogen or an alkyl substituent having from 1 to 4 carbon atoms; and each n is a number of from 0 (zero) to 4. Diphenols wherein R represents an alkylidene radical having from 2 to 4 carbon atoms, and R' and R" represent an alkylene radical of from 3 to 4 carbon atoms are preferred as greater blocking resistance, increased definition of xerographic characters, and more complete transfer of the toner images is achieved. Optimum results are obtained with diols in which R is an isopropylidene radical, R' and R" are selected from the group consisting of propylene and butylene substituents, and n is 1 (one), as the resins formed from these diols posses higher agglomeration resistance and penetrate extremely rapidly into paper receiving sheets.

Typical useful diphenols are 2,2-bis(4-beta hydroxy ethoxy phenyl)-propane; 2,2-bis(4-hydroxy isopropoxy phenyl)propane; 2,2-bis(4-beta hydroxy ethoxy phenyl) petane; 2,2-bis(4-beta hydroxy ethoxy phenyl)-butane; 2,2-bis(4-hydroxy-propoxy-phenyl)-butane; 2,2-bis(4-hydroxy-propoxy-phenyl) propane; 1,1-bis(4-hydroxy-ethoxy-phenyl)butane; 1,1-bis(4-hydroxy isopropoxy-phenyl) heptane; 2,2-bis(3-methyl-4-beta-hydroxy ethoxy-phenyl) propane; 1,1-bis(4-beta hydroxy ethoxy phenyl) cyclohexane; 2,2'-bis(4-beta hydroxy ethoxy phenyl)-norbornane; 2,2'-bis(4-beta hydroxy ethoxy phenyl) norbornane; 2,2-bis(4-beta hydroxy styryl oxyphenyl) propane; the polyoxy-ethylene ether of isopropylidene diphenol in which both phenolic hydroxyl groups are oxyethylated and the average number of oxyethylene groups per mole is 2.6; the polyoxypropylene ether of 2-butylidene diphenol, in which both the phenolic hydroxyl groups are oxyalkylated and the average number of oxypropylene groups per mole is 2.5; and the like.

Suitable dicarboxylic acids, or the anhydrides thereof that may be reacted with the diols described to form the referenced polyester toner resins, which acids may be substituted, unsubstituted, saturated or unsaturated, include those of the general formula:

HOOCR'''COOH wherein R''' is selected from a substituted or unsubstituted alkylene group with from 1 to about 12 carbon atoms, and arylene or alkylene arylene substituents of from 10 to about 12 carbon atoms. Typical dicarboxylic acids are: oxalic acid, malonic acid, succinic acid, glutaric acid, adipic acid, pimelic acid, suberic acid, azelaic acid, sebacic acid, phthalic acid, mexaconic acid, homophthalic acid, isophthalic acid, terephthalic acid, o-phenyleneacetic-beta-propionic acid, itaconic acid, maleic acid, maleic acid anhydrides, fumaric acid, phthalic acid anhydride, traumatic acid, citraconic acid, and similar equivalent acids. Dicarboxylic acids with from 3 to 5 carbon atoms are preferred as the resulting toner resins possess greater resistance to film formation on reusable imaging surfaces. Optimum results are obtained with alpha unsaturated dicarboxylic acids, such as fumaric acid, maleic acid, or maleic acid anhydride as maximum resistance to physical degradation of the toner, as well as rapid melting properties are achieved. Although it is not entirely clear, it is believed that the presence of the unsaturated bonds in the alpha unsaturated dicarboxylic acid reactants provides the resin molecules with a degree of toughness without adversely affecting the fusing and comminution characteristics. One of the preferred specific polyester materials useful in the process of the present invention is comprised of the reaction product of 2,2-bis(4-hydroxy isopropoxy phenyl) propane and fumaric acid.

Illustrative examples of magnetic materials that may be selected for the toner composition useful in the present invention include, for example, magnetites such as $Fe_2O_3$; $Fe_3O_4$; Mapico Black, a commercially available material: MO-4232, a magnetite commercially available from Pfizer Pigment Company, New York, N.Y.; K-378, a magnetite commercially available from Northern Pigments Corporation, Toronto, Ontario, Canada; and mixtures thereof. Mapico Black is preferred in that the particles are black in color, of low cost, and provide excellent magnetic properties.

The amount of magnetic pigment selected can vary, however, in one preferred embodiment of the present invention, from about 20 to about 40 percent by weight is selected. Also, the amount of magnetic pigment present can be from about 15 percent to about 60 percent by weight, or any other effective amount providing the objectives of the present invention are achievable. The amount of polyester material present, for example, is from about 50 percent to about 85 percent by weight, and preferably from about 70 to about 80 percent by weight. With the preferred amount of magnetic pigment, fewer toner particles separate from the carrier particles.

The waxy material incorporated into the toner composition generally has a molecular weight of between from about 500 and to about 20,000, and preferably is of a molecular weight of from about 1,000 to about 6,000. Illustrative examples of low molecular weight waxy materials included within the scope of the present invention are polyethylenes, commercially available from Allied Chemical and Petrolite Corporation; Epolene N-15, commercially available from Eastman Chemical Products Inc.; Viscol 550-P, a low molecular weight polypropylene available from Sanyo Kasei K.K.; and similar materials. The commercially available polyethylenes selected have a molecular weight of from about 1,000 to about 1,500, while the commercially available polypropylenes incorporated into the toner compositions of the present invention have a molecular weight of from about 4,000 to about 6,000. Many of the polyethylene and polypropylene compositions useful in the present invention are illustrated in British Patent 1,442,835, the disclosure of which is totally incorporated herein by reference. The wax component can be incorporated into the toner composition in various suitable effective amounts; however, generally these waxes are present in an amount of from about 2 percent by weight to about 20 percent by weight, and preferably are present in an amount of from about 5 percent by weight to about 10 percent by weight.

External additives added as optional ingredients to the developer composition of the present invention include colloidal silicas, such as Aerosil; metal salts; metal salts of fatty acids, such as zinc stearate; mixtures thereof; and the like, reference U.S. Pat. No. 3,983,045, the disclosure of which is totally incorporated herein by reference; and U.S. Pat. No. 3,320,169, the disclosure of which is totally incorporated herein by reference. The Aerosil material can function as a charging source or an abrasive material, while the salts which function as lubricating agents are preferably selected with blade cleaning systems. From about 0.2 percent to about 1.0 percent based on the weight of the toner ingredients, and preferably from about 0.5 percent to about 0.8 percent of the colloidal silicas are selected for incorporation into the toner composition. The external salt additives are present in an amount of from about 0.10 percent to about 1.0 percent, and preferably from about 0.3 percent to 0.5 percent. Percentages outside these ranges may be useful providing the objectives of the present invention are achievable.

As other additive components, there may be included in the developer composition of the invention pigments such as carbon black, including Black Pearls L, REGAL® 330, VULCAN®, mixtures thereof, and the like. The carbon black is usually present in an amount of from about 1 percent to about 10 percent by weight, and preferably in an amount of from about 2 percent to about 5 percent by weight, based on the weight of the toner components. Also, with the process of the present invention there can be selected toner compositions without magnetite, and containing therein as the exclusive pigment carbon black particles. Furthermore, mixtures of carbon black and magnetites may be useful.

Typical carrier materials that can be used for forming the two component developing composition of the present invention include those that are capable of triboelectrically obtaining a charge of opposite polarity to that of the toner particles. Examples of carriers include potassium chloride, Rochelle salt, sodium nitrate, aluminum nitrate, potassium chlorate, granular zircon, granular silicon, methyl methacrylate, glass, steel, nickel, iron ferrites, silicon dioxide, and the like. Preferably, the carrier particles selected contain coatings thereover inclusive of polymethyl methacrylates; terpolymers of styrene, methacrylate, and organo silanes, reference U.S. Pat. No. 3,526,533, the disclosure of which is totally incorporated herein by reference; and other similar equivalent coatings. Also, nickel berry carriers as illustrated in U.S. Pat. Nos. 3,847,604 and 3,767,598, the disclosures of which are incorporated herein by reference, may be useful. These carriers are comprised of nodular beads of nickel with surfaces of reoccurring recesses and protrusions providing particles with a relatively large external area. The diameter of the coated carrier particles is from about 50 to about 500 microns thus allowing the carrier to present sufficient density and inertia to avoid adherence to the electrostatic images during the development process. The preferred carrier is comprised of a steel core coated with a polymethyl methacrylate resin, or the terpolymer resins of U.S. Pat. Nos. 3,526,533 and 3,467,634, the disclosures of which are totally incorporated herein by reference.

Also, the carrier component may be mixed with the toner compositions in various effective suitable combinations, however, best results are obtained when there is used from about 0.5 parts to about 10 parts of toner to 100 to 200 parts by weight of carrier, and preferably from about 3 parts of toner to 100 parts by weight of carrier.

The compositions of the present invention may be selected for the development of images in an electrostatographic apparatus having preferably incorporated therein various different inorganic photoreceptors including amorphous selenium, selenium alloys, such as selenium antimony, selenium tellurium, selenium antimony tellurium, and selenium arsenic. Examples of organic photoreceptors that may be selected are polyvinyl carbazole; 4-dimethylamino benzylidene; benzhydrazide; 2-benzylidene-amino-carbazole; polyvinylcarbazole; para bromo aniline; 2,4-diphenyl quinazoline; 1,2,4-triazine; 1,5-diphenyl 3-methyl pyrazoline; 2-(4'-dimethylamino phenyl)-benzoxazole; 3-amino carbazole; and polyvinyl-carbazole-trinitrofluorenone charge transfer complexes. Also, layered photoreceptors, including those described in U.S. Pat. No. 4,265,990, the disclosure of which is totally incorporated herein by reference, may be selected providing the toner composition is positively charged with, for example, charge enhancing additives such as cetyl pyridinium chloride.

Numerous different known methods can be utilized for preparing the toner and developers of the present invention including spray drying, jetting, and the like; however, one preferred method of preparation involves hot melt formation and mastication of the toner resin, and magnetite using a Bambury rubber mill process, followed by attrition to obtain toner particle sizes of less than 25 microns on the average, reference U.S. Pat. No. 4,293,627, the disclosure of which is totally incorporated herein by reference.

When using the developers of the present invention in electrostatographic imaging processes, substantially no contamination of the machine components results; or the contamination was so slight so as to not adversely affect the quality of the images generated. This was demonstrated, for example, by comparing the amount of toner that was deposited on a machine component when using the toners of the present invention with prior art toner compositions. Therefore, the compositions of the present invention are very useful in xerographic or magnetic imaging processes. In these processes, the developer composition of the present invention is selected for rendering the images visible, followed by image transfer to a suitable substrate, and thereafter permanently affixing the image thereto. Specifically, in xerographic processes with the developer of the present invention, images of exceptional quality were continuously generated over extended time periods with substantially no unwanted toner deposition resulting on machine components as described herein.

Furthermore, with the imaging processes of the present invention there are selected original documents developed with the waxy toner compositions disclosed herein, which documents are abrasion resistant for a substantially unlimited number of copying cycles exceeding, for example 50,000 in some instances; and when selected for the generation of additional copies, they are substantially free of dark bands thereon. The aforementioned copies also have substantially no enhanced image defects, and they may be abrasion resistant when the waxy toner composition is selected.

One particularly preferred developer composition selected for the imaging and printing process of the present invention is comprised of from about 70 to 75 percent by weight of a linear or branched polyester resin, about 15 to about 21 percent by weight of magnetite, from about 5 to about 8 percent by weight of carbon black, and from about 1 to about 5 percent by weight of a low molecular weight wax. A preferred carrier component contains an oxidized steel core with a coating thereover of polymethylmethacrylate or a terpolymer of styrene methylmethacrylate, and an organo silane as disclosed hereinbefore. Additionally, as additives there is present from about 0.1 to 1 percent by weight of zinc stearate, and from about 0.1 to 1 percent, and preferably 0.55 percent by weight of colloidal silica particles.

For two component developer compositions the toners illustrated herein are admixed with carrier components in various effective amounts. As carriers there can be selected various suitable materials including those comprised of cores of iron, steel, ferrites, and the like, reference for example U.S. Pat. Nos. 3,839,029; 3,847,604, 3,849,182; 3,929,657; and 3,914,181, the disclosures of each of these patents being totally incorporated herein by reference. Moreover, the carrier cores can contain thereover a continuous or semicontinuous coating of various polymers inclusive of fluoropolymers, styrene polymers, terpolymers, mixtures of polymers, polymethylmetharylates, and the like, reference for example U.S. Pat. Nos. 3,467,634; 3,526,533; 3,627,522; 3,849,182 and 3,923,503, the disclosures of each of these patents being totally incorporated herein by reference. Other known coated and uncoated carriers can be selected provided the objectives of the present invention are achievable. With further respect to the two component developer compositions, the carrier particles can be mixed with the toner composition in various suitable effective combinations including, for example, about 1 part per toner to about 10 parts to about 200 parts by weight of carrier; and preferably about 1 to about 5 parts by weight of toner to about 100 parts by weight of carrier particles. Moreover, in other embodiments of the present invention it may be suitable to incorporate into the carrier coatings various conductive pigments such as carbon black in an amount of, for example, from about 15 percent by weight to about 30 percent by weight.

The invention will now be described in detail with respect to specific preferred embodiments thereof, it being understood that these examples are intended to be illustrative only. The invention is not intended to be limited to the specific materials, process parameters, and the like recited; and equivalents thereof are intended. All parts and percentages are by weight unless otherwise indicated.

EXAMPLE I

There was prepared by melt mixing followed by mechanical attrition a toner composition containing 77.5 percent by weight of the polyester resin which is the reaction product of 2,2-bis(4-hydroxy isopropoxy phenol) propane and fumaric acid, and is commercially available from ICI Corporation; 20 percent by weight of the magnetite iron oxide commercially available as Mapico Black; 2.5 percent by weight of a low molecular weight, about 4 to 5,000, wax polypropylene available from Sanyo Corporation as Viscol 550-P; and as external additives (not part of the resin blend) 0.65 percent by weight of Aerosil R972, and 0.35 percent by weight of zinc stearate.

Three parts by weight of the above prepared toner composition together with 100 parts by weight of carrier particles comprised of steel cores coated with a polymethyl methacrylate resin, 0.125 percent coating weight, were admixed together resulting in a two-component developer composition, which when used in the xerographic imaging apparatus, commercially available as the Xerox Corporation 3100®, with magnetic brush development generated high quality copies of exceptional resolution, and substantially no background for about 25,000 imaging cycles. Inspection of the 3100® machine components, including the optical system, revealed substantially no deposition of toner particles, or other contamination.

A second developer composition was prepared by repeating the above procedure with the exception that there was selected as the carrier coating instead of the polymethacrylate resin, a terpolymer of styrene, methylmethacrylate, and a vinyl triethoxy silane, reference U.S. Pat. Nos. 3,467,634 and 3,526,533, the disclosures of which are totally incorporated herein by reference. Substantially similar results were obtained when this developer composition was incorporated into the Xerox Corporation 3100® machine apparatus.

Thereafter, original imaged documents were generated in a 9700® printing apparatus, followed by development with the above-prepared first toner composition. Additionally, original imaged documents were generated in a 9700® printing apparatus followed by development with the above prepared second developer composition. These imaged originals containing about 50 percent of the imaged documents developed with the first toner composition, and 50 percent of the imaged documents developed with the second toner composition were then selected for the generation of 25,000 copies in the Xerox Corporation 9500® imaging apparatus. There resulted developed images of excellent resolution, no background deposits, subsequent to radiant or flash fusing, 6 Joules/in$^2$ and 9 Joules/in$^2$; and further, the absence of dark bands was noted on all 25,000 copies. Furthermore, an absence of image defects was noted on all 25,000 copies; and the original documents remained substantially free of abrasion. Also, no image disruption, that is they were abrasion resistant, was present on the original document for 25,000 imaging cycles.

EXAMPLE II

A toner composition was prepared by repeating the procedure of Example I with the exception that there was added 6 percent by weight of carbon black particles, about 71.5 percent by weight of the polyester resin to the other components indicated. Substantially similar results were observed when images were generated from the original document with the above developer composition in a Xerox Corporation 3100®. Specifically, there was no copy failure in the automatic document handler for 25,000 cycles as compared to failure at from about 5 to 10 cycles with an identical developer composition with the exception that it contained therein no P550 wax.

Additionally, the original imaged documents remained substantially free of abrasion, that is, the image present thereon were not disturbed in any manner for 25,000 imaging cycles; and further there was an absence of dark bands on all 25,000 copies generated from the imaged original document. In contrast, an identical developer composition with the exception that it contained no P550 wax generated images in the 3100® with dark bands thereon after about 10 imaging cycles; and moreover, the original imaged document utilized, which was developed with the identical toner composition with no P550 wax was not abrasion resistant in that the image thereon was disturbed and did not conform to the original image as generated after about 18 imaging cycles. Also, the images resulting from the original imaged document developed with the toner composition with wax therein possessed less gloss characteristics than images obtained from an original image document with an identical developer composition with the exception that it contained no P550 wax.

Similar results were obtained as reported in Examples I and II with single component toner compositions comprised of the same components in the amounts specified, and no carrier particles.

Other modifications of the present invention will occur to those skilled in the art upon a reading of the present application. These modifications and equivalents thereof are intended to be included within the scope of this invention.

What is claimed is:

1. An improved process for generating images from an original document which comprises (1) providing an original document with an image thereon generated in a xerographic imaging or printing apparatus, which image is developed with a composition comprising toner resin particles, pigment particles, a low molecular weight wax, and additive particles; (2) subsequently introducing the original document into a document handler in a xerographic imaging apparatus; and (3) thereafter circulating the original document through the document handler at least five times and generating copies of the original document, which copies exhibit substantially no dark bands, and wherein the original document remains abrasion resistant, and contains thereon the image as originally formulated for an extended number of imaging cycles, wherein the image on the original document is permanently affixed to a substrate by radiant or flash fusing processes.

2. A process in accordance with claim 1 wherein the resin particles comprise polyesters.

3. A process in accordance with claim 1 wherein the wax is selected from the group consisting of polyethylene and polypropylene.

4. A process in accordance with claim 1 wherein the molecular weight of the wax is less than about 6,000.

5. A process in accordance with claim 1 wherein the additive particles are selected from the group consisting of colloidal silicas, metal salts of fatty acids, and metal salts.

6. A process in accordance with claim 1 wherein the images generated from the original document are permanently affixed with radiant or flash fusing processes.

7. A process in accordance with claim 1 wherein the resin particles comprise styrene polymers.

8. A process in accordance with claim 1 wherein the resin particles comprise styrene methacrylates, styrene acrylates, styrene butadienes, or polyesters.

9. A process in accordance with claim 1 wherein the pigment particles are carbon black.

10. A process in accordance with claim 1 wherein the pigment particles are magnetite.

11. A process in accordance with claim 1 wherein the wax is of a molecular weight of from about 1,000 to about 20,000.

12. A process in accordance with claim 1 wherein the wax is selected from the group consisting of polyethylene and polypropylene with a molecular weight of less than about 6,000.

13. A process in accordance with claim 1 wherein the additive particles comprise colloidal silicas.

14. A process in accordance with claim 1 wherein the additive particles comprise zinc stearate.

15. A process in accordance with claim 1 wherein the original document remains abrasion resistant for 25,000 imaging cycles.

16. A process in accordance with claim 1 wherein the images generated from the original document contain no dark bands thereon for 25,000 imaging cycles.

17. A process in accordance with claim 1 wherein the composition further includes carrier particles.

18. A process in accordance with claim 17 wherein the carrier core comprises steel.

19. A process in accordance with claim 17 wherein the carrier core comprises steel with a coating thereover.

20. A process in accordance with claim 19 wherein the coating is selected from the group consisting of polymethylmethacrylate and a terpolymer of styrene, methylmethacrylate, and an organo silane.

21. A process in accordance with claim 1 wherein the pigment is magnetite present in an amount of from about 20 percent by weight to about 50 percent by weight.

22. A process in accordance with claim 1 wherein the resin particles are present in an amount of from about 40 percent by weight to about 80 percent by weight.

23. A process in accordance with claim 1 wherein the resin is a polyester obtained from the reaction of 2,2-bis(4-hydroxyisopropoxy phenyl) propane and fumaric acid.

24. A process in accordance with claim 1 wherein the additive particles are colloidal silica present in an amount of about 0.2 percent by weight to about 0.8 percent by weight.

25. A process in accordance with claim 1 wherein the additive particles are metal salt of a fatty acid present in an amount of from 0.1 percent by weight to about 0.6 percent by weight.

26. A process in accordance with claim 1 wherein the additive particles are colloidal silica present in an amount of about 0.65 percent by weight and zinc stearate present in an amount of about 0.35 percent by weight.

27. A process in accordance with claim 1 wherein the waxy component is present in an amount of from about 1 percent by weight to about 10 percent by weight.

28. A process in accordance with claim 1 wherein the polyester resin comprises a dicarboxylic acid and a diol comprising a diphenol of the formula

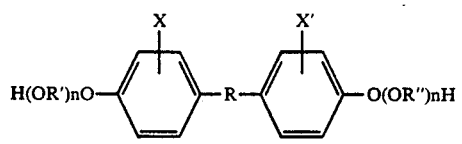

wherein R is selected from the group consisting of substituted and unsubstituted alkylene radicals of from about 2 to about 12 carbon atoms, alkylidene substituents with from 1 to about 12 carbon atoms, and cycloalkylidene radicals of from 3 to 12 carbon atoms; R' and R'' are selected from the group consisting of substituted and unsubstituted alkylene groups of from 2 to 12 carbon atoms; alkylene arylene groups of from 8 to 12 carbon atoms, and arylene groups; and X and X' are selected from the group consisting of hydrogen or an alkyl group with from 1 to about 4 carbon atoms; and each n is a number of from 0 (zero) to 4.

* * * * *